US010583347B2

(12) United States Patent
Proulx

(10) Patent No.: US 10,583,347 B2
(45) Date of Patent: Mar. 10, 2020

(54) BLADE SHARPENING SYSTEM AND METHOD OF USING THE SAME

(71) Applicant: AIGUISAGE ELITE INC., St-Mathieu-de-Beloeil (CA)

(72) Inventor: Denis Proulx, Beloeil (CA)

(73) Assignee: AIGUISAGE ELITE INC., Montreal (CA)

( * ) Notice: Subject to any disclaimer, the term of this patent is extended or adjusted under 35 U.S.C. 154(b) by 51 days.

(21) Appl. No.: 15/570,083

(22) PCT Filed: Apr. 27, 2016

(86) PCT No.: PCT/CA2016/050485

§ 371 (c)(1),
(2) Date: Oct. 27, 2017

(87) PCT Pub. No.: WO2016/172794

PCT Pub. Date: Nov. 3, 2016

(65) Prior Publication Data

US 2018/0126250 A1 May 10, 2018

Related U.S. Application Data

(60) Provisional application No. 62/153,179, filed on Apr. 27, 2015.

(51) Int. Cl.
*A63C 3/10* (2006.01)
*B24B 9/04* (2006.01)
(Continued)

(52) U.S. Cl.
CPC ..... *A63C 3/10* (2013.01); *B24B 3/003* (2013.01); *B24B 9/04* (2013.01); *B24B 27/0023* (2013.01); *B24B 27/0076* (2013.01); *B24B 27/0084* (2013.01); *B24B 27/065* (2013.01); *B24B 27/0666* (2013.01); *B24B 27/0675* (2013.01); *B24B 41/06* (2013.01); *B24B 41/042* (2013.01)

(58) Field of Classification Search
CPC .. A63C 3/10; B24B 3/003; B24B 9/04; B24B 27/0023; B24B 27/0076; B24B 27/0084; B24B 27/065; B24B 27/0666; B24B 9/0675; B24B 41/042; B24B 41/065; B24B 49/04; B24B 49/16
See application file for complete search history.

(56) References Cited

U.S. PATENT DOCUMENTS 1,487,142 A * 3/1924 Boker ..... B24B 3/003 451/213
2,438,543 A * 3/1948 Custin ..... B24B 3/003 451/153

(Continued)

OTHER PUBLICATIONS

International Search Report from PCT/CA2016/050485; dated Jun. 29, 2016; Maxime Bazinet.

*Primary Examiner* — Timothy V Eley
(74) *Attorney, Agent, or Firm* — Benoit & Cote, Inc.; Mathieu Miron

(57) ABSTRACT

The present document describes a blade sharpening system comprising a blade sharpening device, a blade holding apparatus and a controller operatively coupled to the blade sharpening device and said blade holding apparatus to control sharpening of said blade, and methods of using the same.

20 Claims, 11 Drawing Sheets

(51) Int. Cl.

| | |
|---|---|
| ***B24B 27/06*** | (2006.01) |
| ***B24B 3/00*** | (2006.01) |
| ***B24B 27/00*** | (2006.01) |
| ***B24B 41/04*** | (2006.01) |
| ***B24B 41/06*** | (2012.01) |

(56) References Cited

U.S. PATENT DOCUMENTS

| | | | | |
|---|---|---|---|---|
| 3,735,533 | A * | 5/1973 | Salberg | B24B 3/003 451/152 |
| 3,827,185 | A * | 8/1974 | Smith | B24B 3/003 451/224 |
| 4,235,050 | A | 11/1980 | Hannaford et al. | |
| 4,558,541 | A | 12/1985 | Consay | |
| 4,722,152 | A | 2/1988 | Ek et al. | |
| 4,817,339 | A * | 4/1989 | Weidmo | B24B 3/003 451/28 |
| 5,009,039 | A * | 4/1991 | Lager | A63C 3/10 451/11 |
| 5,601,473 | A | 2/1997 | Strain et al. | |
| 9,114,498 | B1 * | 8/2015 | Layton, Jr. | B24B 3/003 |
| 9,517,543 | B2 * | 12/2016 | Proulx | B24B 9/04 |
| 9,566,682 | B2 * | 2/2017 | Layton, Jr. | B24B 3/003 |
| 2012/0108151 | A1 | 5/2012 | Swist | |
| 2014/0179201 | A1 | 6/2014 | Proulx | |
| 2017/0252901 | A1 * | 9/2017 | Layton, Jr. | A63C 1/303 |

* cited by examiner

BLADE SHARPENING SYSTEM AND METHOD OF USING THE SAME

CROSS-REFERENCE TO RELATED APPLICATIONS

This application is a US National Phase under 35 USC § 371 of PCT/CA2016/050485, filed Apr. 27, 2016, which claims priority from and the benefit of U.S. Provisional Patent Application 62/153,179 filed Apr. 27, 2015, the specification of which is hereby incorporated by reference in its entirety.

BACKGROUND

(a) Field

The subject matter disclosed generally relates to blade sharpening and more specifically to blade sharpening apparatuses and methods of using the same to produce sharpened skate blades.

(b) Related Prior Art

Blade sharpening devices for sharpening of all types of blades ranging from cutting blade and skating blades are known.

For example, cutting blade sharpening devices are known which have two or more pairs of grinding rollers or wheels located in mutually facing positions with their respective lateral grinding surfaces in adjacent relation. The blade is sharpened by being interposed between the two rollers with the blade edge contacting the grinding surfaces and causing the rollers to rotate about respective parallel axes with opposite directions of rotation.

A first drawback of such a solution consists in that rigidly held grinding rollers provide a blade having a profile, whose quality is not always acceptable. An additional drawback of these known solutions is that, during sharpening, the blade has to be pressed against the roller, and is thus heated, which may cause loss of hardness of the material, usually steel. Another drawback is that the top-to-bottom rotation of the grinding surfaces of the rollers causes burr build-up that forces frequent process stops for burr removal.

A further drawback is that prior art sharpening devices are mounted to fixed shells which set an operating position thereof, and introduction of the blades to be sharpened from both sharpening sides between the grinding members, for better sharpening, requires users to repeatedly move around the device for direct access to each side.

Another drawback is that, during blade sharpening, the user that holds the blades may inadvertently introduce them through an excessive distance between the grinding members, with the blade handles possibly contacting the latter and being damaged by their fast rotation, as soon as contact occurs.

Ice skates typically have a convex shape along a length of the skate blade and a concave shape across the width of the blade, defining two edges along the length of the blade. A skater can use either of these two edges in executing maneuvers on the ice surface. To maintain a desired blade configuration, a skate sharpening apparatus must be employed to re-grind the lower surface of the blade to create a groove along the length of the blade according to the preferred profile.

Skate blades differ from one pair to another. In the prior art, such as Canadian Patent 2,309,222C, the operator of a skate sharpening machine is required to first dress a grinding wheel, which is usually carried out using a single point diamond dresser that is pivoted about an axis generally perpendicular to an axis of rotation of the grinding wheel. The single point diamond dresser intersects the outer periphery of the grinding wheel, removing material from the wheel to create and define a grinding wheel contour.

A drawback of such solution is that to have the desired contour applied to the skate blade, one must manually ensure that during the grinding process the centerline of the contour on a wheel coincides with the centerline of the blade along its full length. When each centerline is not carefully matched, an irregular groove will be created along the length of the blade, with one edge being higher/lower than the other. The contour formed on the grinding wheel may range from a convex arcuate surface with a radius typically in the range of 0.25 inch to 2 inches (0.635 to 5.08 cm) through to a triangular profile. Therefore, ice skate blade profiles have evolved into different profiles of blade between speed skating and ice dance, defender, goalie, attacker, short speed and long speed.

Accordingly it would be desirable to provide an ice skate blade sharpening machine that allows for sharpening multiple blades simultaneously allowing accurate alignment of profiles for example within a single player's pair, across multiple pairs for a user or simply to reduce time and cost in retail establishments offering blade sharpening services.

SUMMARY

According to an embodiment, there is provided a blade sharpening system comprising:

- a blade sharpening device configured to contact the blade, comprising:
  - a grinding assembly, configured to
    - slide according to a longitudinal trajectory along a length of the blade and grind the blade, and
    - at least one of
      - grind the blade with a variable grinding pressure;
      - measure a shape of the blade; and
      - grind the blade according to the measured shape of the blade with a variable grinding pressure;
- a blade holding apparatus to slide the blade over the blade sharpening device, comprising
  - parallel first and second gripping members for contacting opposite sides of the blade and align an edge of the blade with the grinding assembly; and
- a controller operatively coupled to the blade sharpening device and the blade holding apparatus, configured to at least one of
  - control sharpening of the blade according to the variable grinding pressure exerted during sharpening on the blade by the grinding assembly,
  - measure the shape of the blade, and
  - control sharpening of the blade according to the measured shape of the blade according to the variable grinding pressure exerted during sharpening on the blade by the grinding assembly.

The grinding assembly comprises grinding means.

The grinding means comprises a grinding belt, a grinding strap, a grinding sheet, a milling tool, a grinding rod, a grinding wheel, or combinations thereof.

The grinding means may be a grinding wheel.

The grinding wheel may be demountably attached to a spindle operatively coupled to a grinding wheel drive system.

The grinding wheel may be configured to contact the blade with a variable grinding pressure.

The grinding assembly comprise sensor means for measuring pressure applied to the blade.

The grinding assembly comprise sensor means for measuring the shape of the blade.

The centerline of the grinding wheel may be configured to be in longitudinal alignment with a centerline of the edge of the blade.

The grinding wheel comprises a contour having a convex arcuate surface with a radius from about 0.25 inch (0.635 cm) to about 3 inch (7.62 cm).

The blade sharpening device may further comprise a lever configured to pivot the grinding assembly according to the predetermined shape of the blade.

The blade sharpening device may further comprise an arm pivotally coupled to the lever to actuate and pivot the lever according to the predetermined shape of the blade.

The blade sharpening device may further comprise a cam coupled to the arm to actuate the arm, the arm being pivotally coupled to the lever to actuate and pivot the lever according to a predetermined shape of the blade.

The blade sharpening device may further comprise a drive means operatively coupled to any one of the level, arm or cam, the drives means being controlled by the controller.

The blade sharpening device may further comprise a balancing mechanism to counterbalance weight of the grinding assembly.

The balancing mechanism may be a weight.

The grinding wheel drive system may be a servomechanism.

The blade holding apparatus further comprises adjustable grip tuning members for abutting the first and second parallel gripping members to provide a substantially even gripping pressure along the blade to straighten the blade.

The blade holding apparatus may further comprise a stage having at least one longitudinal slot in longitudinal alignment with the grinding wheel.

The parallel first and second gripping members are slidably mounted on the stage over the longitudinal slot, for aligning the blade within the longitudinal slot.

The blade holding apparatus may further comprise an actuating member to bring the first and second parallel gripping members in proximity.

The blade holding apparatus may further comprise a blade extremity rest to abut a blade extremity to position the blade in the blade holding apparatus.

The controller may be also operable to control sharpening of the blade control a grinding rotation speed of the grinding wheel;

control the constant or variable grinding pressure of the grinding wheel;

control the position of the blade sharpening device according to a predetermined shape of the blade;

measuring the shape of the blade;

control motion of the blade holding apparatus; and combinations thereof.

The variable grinding pressure has a value determined according to a type of the blade.

The controller further comprises one or more processor, and a memory.

The controller may be further operable to receive and store a blade sharpening parameter set.

The blade sharpening parameter set may comprise at least one of: a height of the grinding wheel with respect to the blade at start of grinding, a height of the grinding wheel with respect to the blade at end of grinding, an initial point of contact with the blade, acceleration time of the blade holding apparatus, speed of the blade holding apparatus, cam speed, cam acceleration time, grinding wheel drive system delay, a predetermined shape of a blade, a variable grinding pressure for a given blade, a constant grinding pressure for a given blade, a constant grinding rotation speed for a given blade, the number of sharpening cycles, and combinations thereof.

According to another embodiment, there may be provided a method of sharpening a blade having with a blade sharpening system of the present invention, comprising contacting at least once the blade with the blade sharpening system.

According to another embodiment, there is provided a method of sharpening a blade having a first and a second portion with a blade sharpening system of the present invention, comprising at least one of steps a) and a') together, and step b):

a) measuring a shape of the first portion of a blade mounted on the blade holding apparatus by contacting the first portion of a blade with the grinding assembly configured for measuring a shape of the blade; and a') contacting the blade with the grinding assembly to sharpen the first portion of a blade according to the shape of the first portion of the blade, and sharpening and measuring a shape of the second portion of the blade by contacting the second portion of a blade with the grinding assembly configured for measuring a shape of the blade, and b) contacting and sharpening the blade mounted on the blade holding apparatus with the grinding assembly according to a pressure profile comprising a first pressure when contacting and sharpening a first extremity of the blade;

a second pressure, higher than the first pressure, when contacting and sharpening a central portion of the blade, and a third pressure, lower than the second pressure when contacting and sharpening a second extremity portion of the blade, according to an entire shape of the blade obtained from the first and second measured portion of the blade, to prevent deformation of the first and second extremity of the blade.

According to another embodiment, there is provided a method of sharpening a blade having a first and a second extremity, and a central portion, with a blade sharpening system of the present invention, comprising the steps:

a) measuring an entire shape of the blade mounted on the blade holding apparatus by contacting the first or second extremity of a blade with the grinding assembly configured for measuring a shape of the blade, and measuring the entire shape of the blade; and b) contacting and sharpening the blade mounted on the blade holding apparatus with the grinding assembly according to a pressure profile comprising a first pressure when contacting and sharpening the first extremity of the blade;

a second pressure, higher than the first pressure, when contacting and sharpening the central portion of the blade, and a third pressure, lower than the second pressure when contacting and sharpening the second extremity portion of the blade, according to the entire shape of the blade, to prevent deformation of the first and second extremity of the blade.

According to another embodiment, there is provided a method of sharpening a blade having a first and a second extremity, and a central portion, with a blade sharpening system of the present invention, comprising the steps:

a) measuring an entire shape of, and simultaneously sharpening the blade mounted on the blade holding apparatus by contacting the first or second extremity of a blade with the grinding assembly configured for measuring a shape of the blade, according to a pressure profile comprising
   - a first pressure when contacting and sharpening the first extremity of the blade;
   - a second pressure, higher than the first pressure, when contacting and sharpening the central portion of the blade, and
   - a third pressure, lower than the second pressure when contacting and sharpening the second extremity portion of the blade, according to the entire shape of the blade to prevent deformation of the first and second extremity of the blade.

In the method of the present invention, upon contacting the blade, the system records a point of contact with the blade.

The contact with the blade may be measured with a sensor means for measuring the shape of the blade.

The first, second or third pressure may be from about 25 grams to about 700 grams.

The constant grinding rotation speed may be maintained over an entire length the blade being sharpened.

The sharpening may be performed at least once.

The sharpening may be performed more than once.

The following terms are defined below.

The term "predetermined shape" is intended to mean that the shape of the blade being sharpened is known to the blade sharpening system. It may have been previously measured and may be for example stored in the controller of the system, or may be accessible for an available source. The predetermined shape of the blade is dependent upon the type (e.g. ice skating, figure skating, speed skating blade) and/or the make (e.g. CCM, Bauer, Easton) of the blade being sharpened.

The term "measure a shape" or "measuring a shape" is intended to mean that the shape of the blade being sharpened may be measure and stored by the blade sharpening system. For example, it may be stored in the controller of the system. The measured shape of the blade is dependent upon the type (e.g. hockey skating, ice skating, figure skating, speed skating blade) and/or the make (e.g. CCM, Bauer, Easton) of the blade being sharpened.

The term "constant grinding pressure" is intended to mean that the pressure applied on the blade being sharpened is constant over the entire length of the surface/edge being sharpened. By pressure, it is meant the weight and/or force applied by the grinding wheel on the blade. Maintaining a constant pressure ensure an even sharpening over the entire length of the edge being sharpened, thereby avoiding waves along the blade's edge.

The term "variable grinding pressure" is intended to mean that the pressure applied on the blade being sharpened is varied over the length of the surface/edge being sharpened. For example, the pressure applied to one extremity of the blade may be lower than the pressure applied to the center of the blade. By pressure, it is meant the weight and/or force applied by the grinding assembly on the blade. Applying different and lower pressures at the extremities than at the center of the blade ensures that in some circumstances (i.e. blade shapes, hardness, or else) the extremities are not deformed by the contact of the grinding assembly on the blade, and ensures an even sharpening over the entire length of the edge being sharpened.

The term "constant grinding rotation speed" is intended to mean that the rotation speed of the grinding wheel is maintained constant over the entire length of the surface/edge being sharpened. Maintaining a constant rotation speed prevents unnecessary heating of the blade being sharpened, which prevent deformation and hardening of the blade during sharpening.

The term "contacting" is intended to mean touching and/or touching and sliding along while maintaining contact with the blade being sharpened or to be sharpened. According to some embodiment, contacting means contacting the whole surface of the blade to be sharpened so as to determine its shape, and commit it to memory.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature, and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
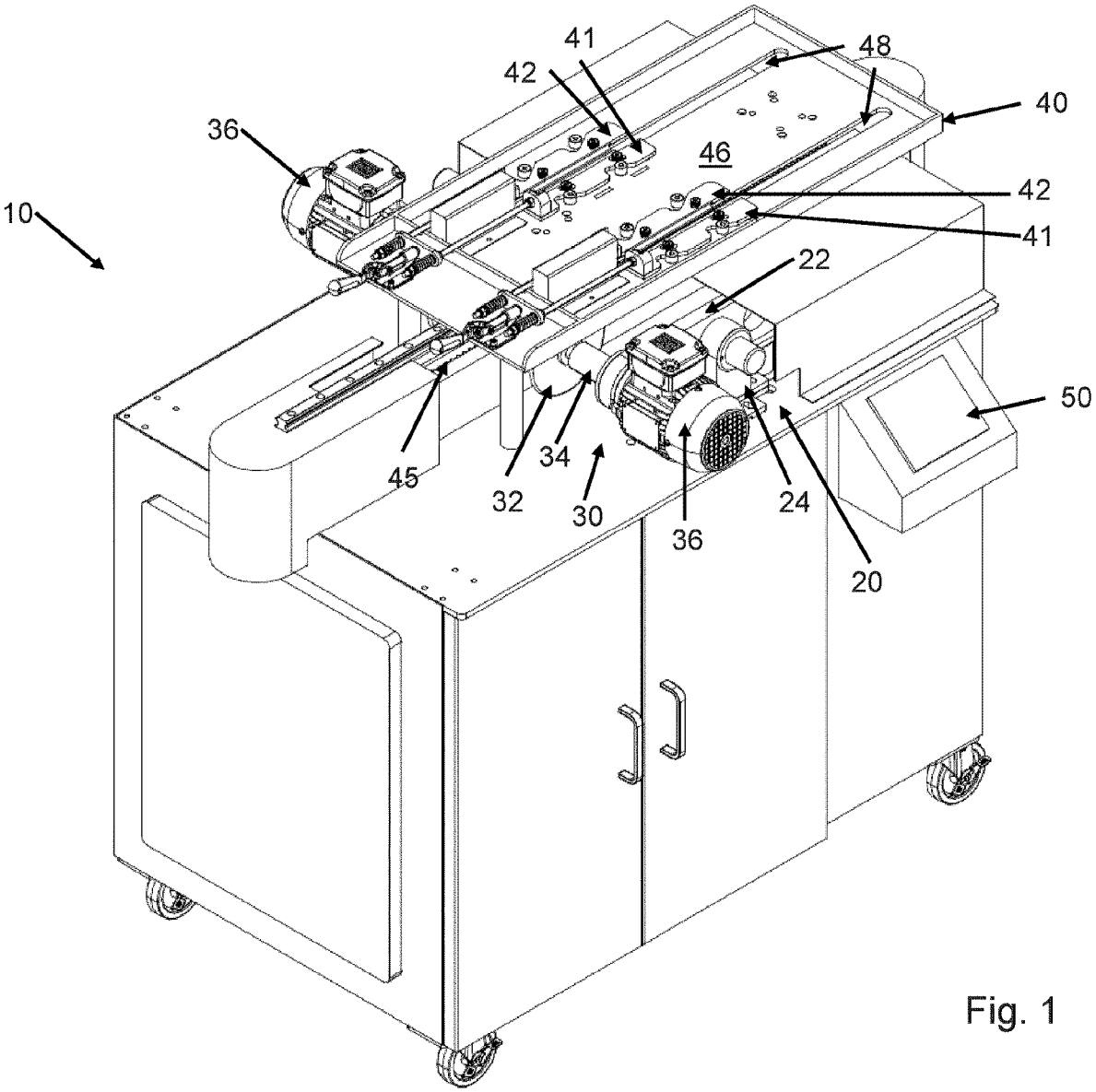
FIG. 1 illustrates a blade sharpening system according to an embodiment of the present invention.

In a first embodiment there is disclosed a blade sharpening system comprising:

a blade sharpening device 20 configured to contact the blade comprising a grinding assembly 30, configured to slide according to a longitudinal trajectory along a length of the blade and grind the blade, and at least one of grind the blade with a variable grinding pressure;

measure a shape of the blade; and grind the blade according to the measured shape of the blade with a variable grinding pressure;

a blade holding apparatus 40 to slide the blade over the blade sharpening device 20, comprising parallel first and second gripping members 41, 42 for contacting opposite sides of the blade and align an edge of the blade with the grinding wheel 32 for sharpening; and a controller 50 operatively coupled to the blade sharpening device 20 and the blade holding apparatus, configured to at least one of control sharpening of the blade according to the variable grinding pressure exerted during sharpening on the blade by the grinding assembly, measure the shape of the blade, and control sharpening of the blade according to the measured shape of the blade according to the variable grinding pressure exerted during sharpening on the blade by the grinding assembly.

In a second embodiment, there is disclosed a method of sharpening blades with a blade sharpening system of the present invention, comprising at least one of steps a) and a') together, and step b):

a) measuring a shape of a first portion of a blade mounted on the blade holding apparatus by contacting the first portion of a blade with the grinding assembly configured for measuring a shape of the blade; and a') contacting the blade with the grinding assembly to sharpen the first portion of a blade according to the shape of the first portion of the blade, and sharpening and measuring a shape of a second portion of the blade by contacting the second portion of a blade with the grinding assembly configured for measuring a shape of the blade, and b) contacting and sharpening a blade mounted on the blade holding apparatus with the grinding assembly according to a pressure profile comprising a first pressure when contacting and sharpening a first extremity of the blade;

a second pressure, higher than the first pressure, when contacting and sharpening a central portion of the blade, and a third pressure, lower than the second pressure when contacting and sharpening a second extremity portion of the blade, according to an entire shape of the blade obtained from the first and second measured portion of the blade, to prevent deformation of the first and second extremity of the blade.

Figure 2:
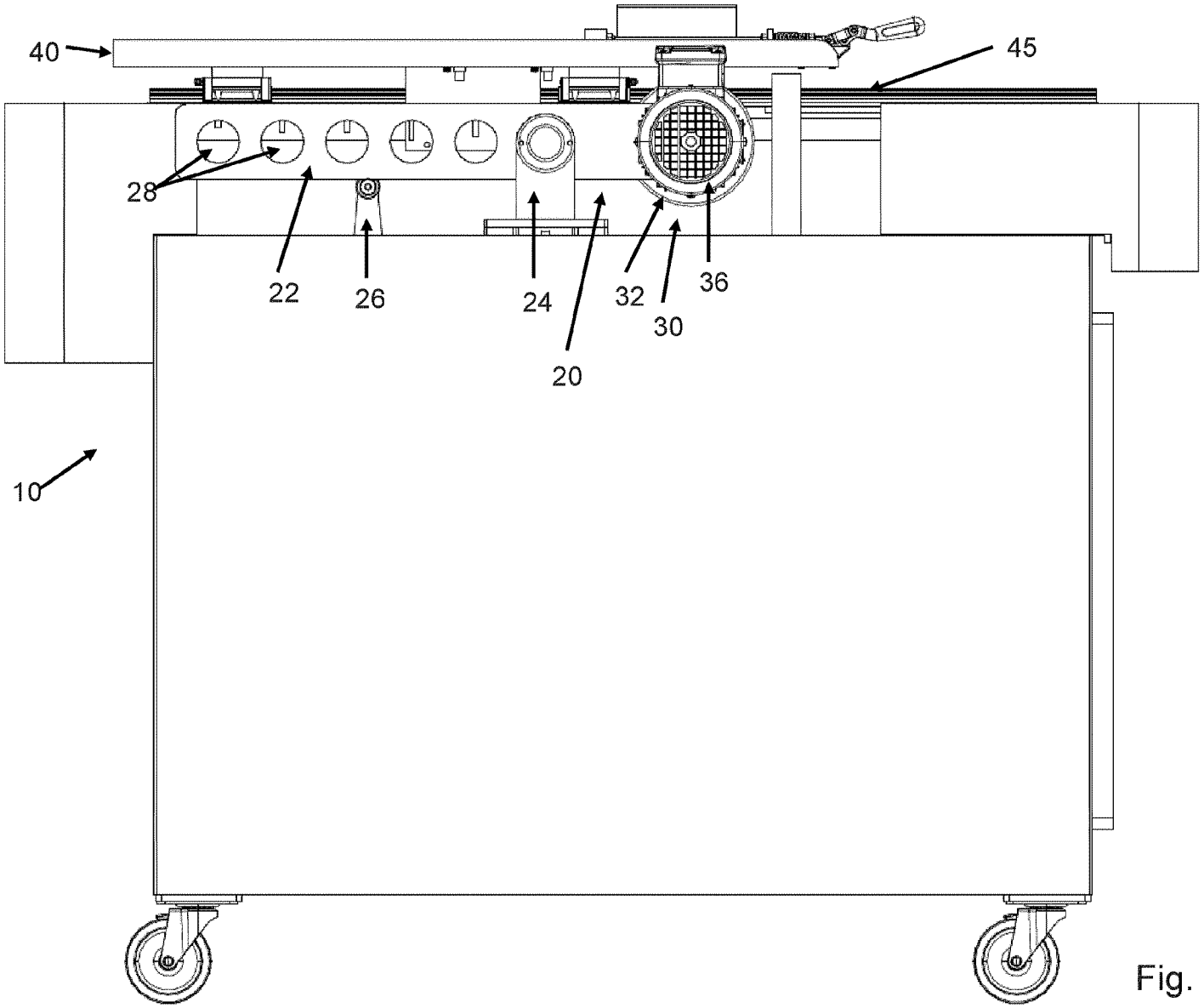
FIG. 2 illustrates a blade sharpening device and a blade holding device from a blade sharpening system according to an embodiment of the present invention.
Figure 3:
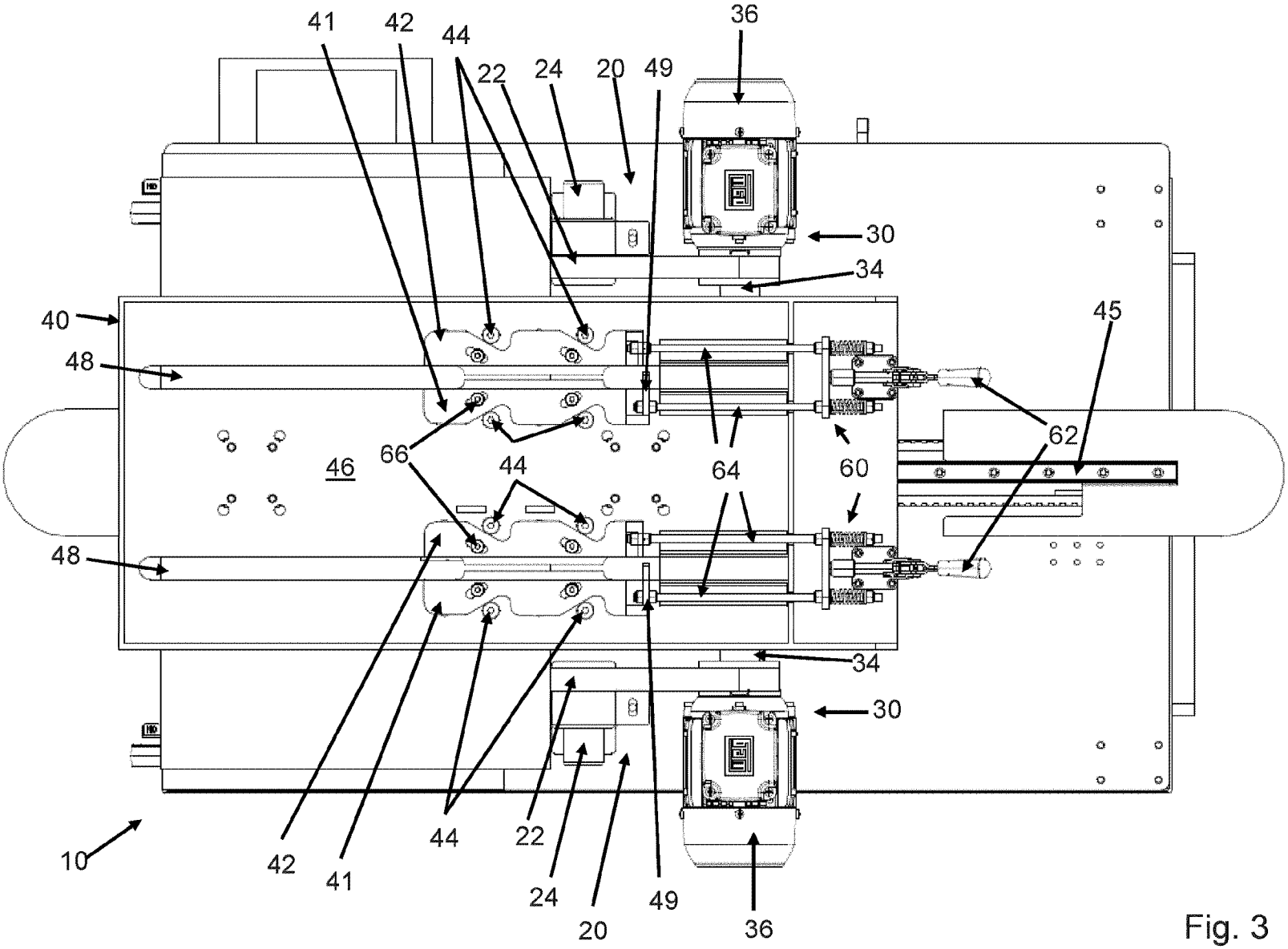
FIG. 3 illustrates a blade holding device over a blade sharpening device from a blade sharpening system according to an embodiment of the present invention.
Figure 4:
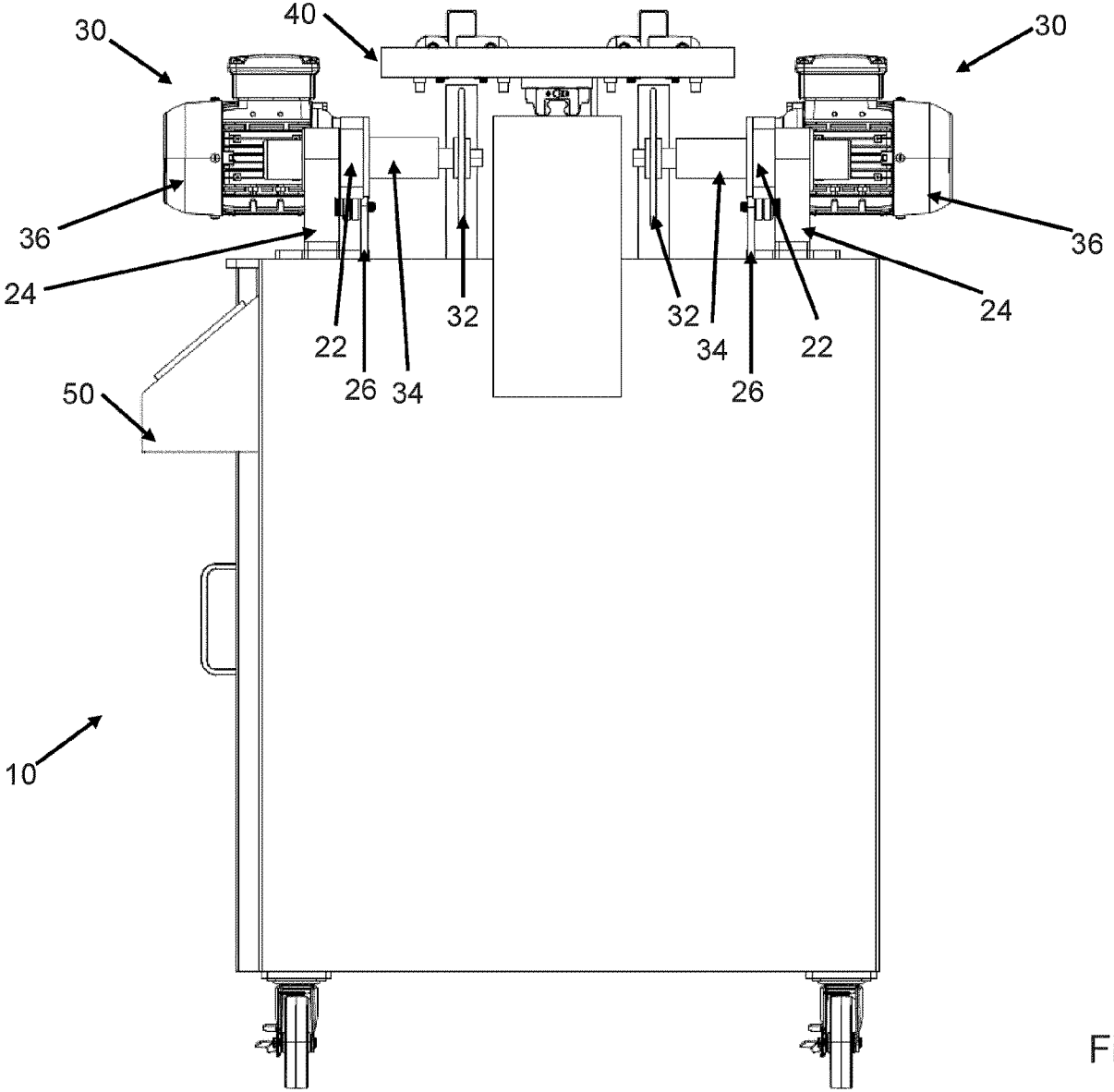
FIG. 4 illustrates a side view of a blade sharpening device and a blade holding device from a blade sharpening system according to an embodiment of the present invention.
Figure 5:
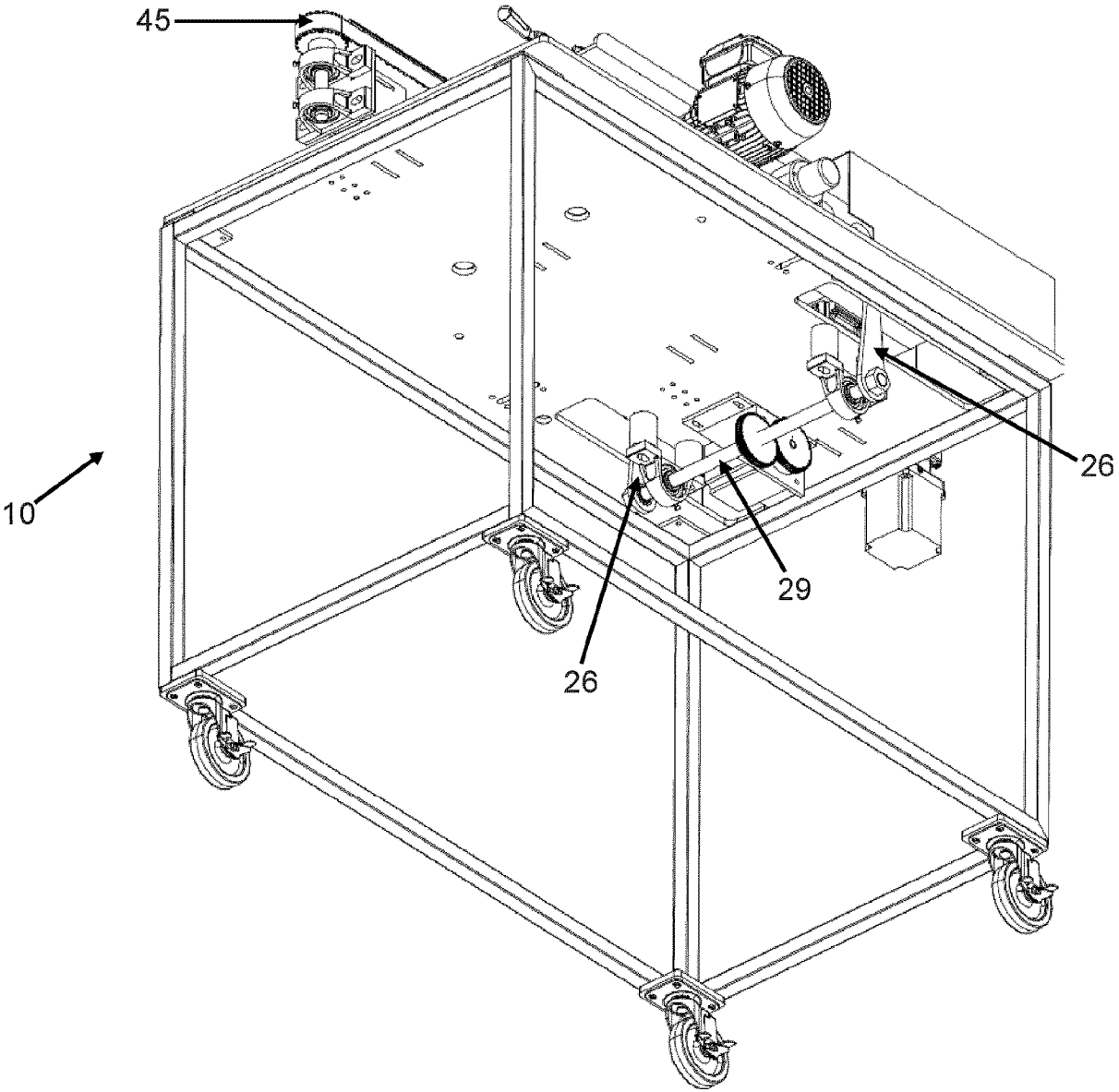
FIG. 5 illustrates a view of a cam and arm of a blade sharpening device from a blade sharpening system according to an embodiment of the present invention.
Figure 6:
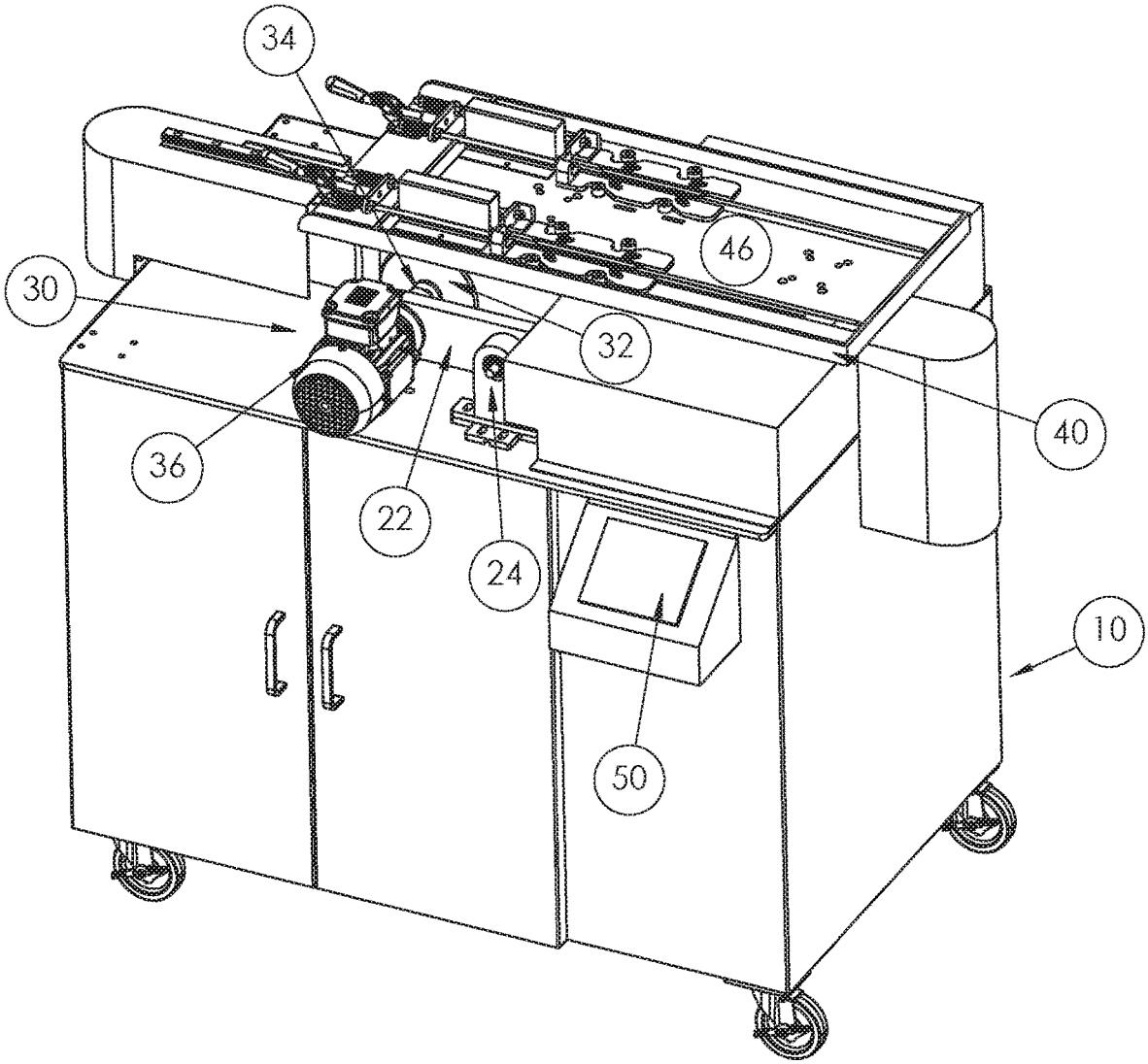
FIG. 6 illustrates a blade sharpening system according to an embodiment of the present invention.
Figure 7:
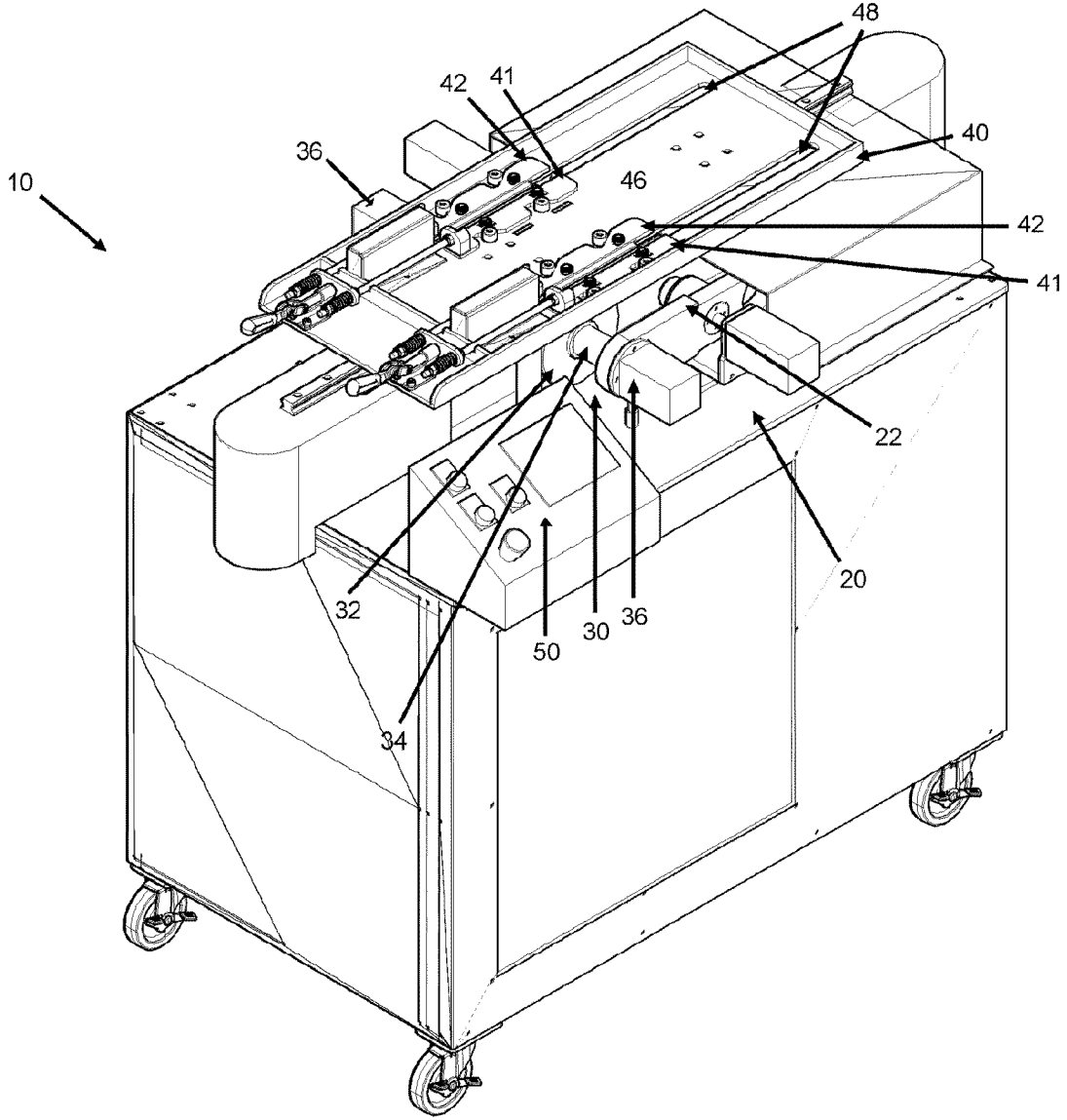
FIG. 7 illustrates a blade sharpening system according to an embodiment of the present invention.
Figure 8:
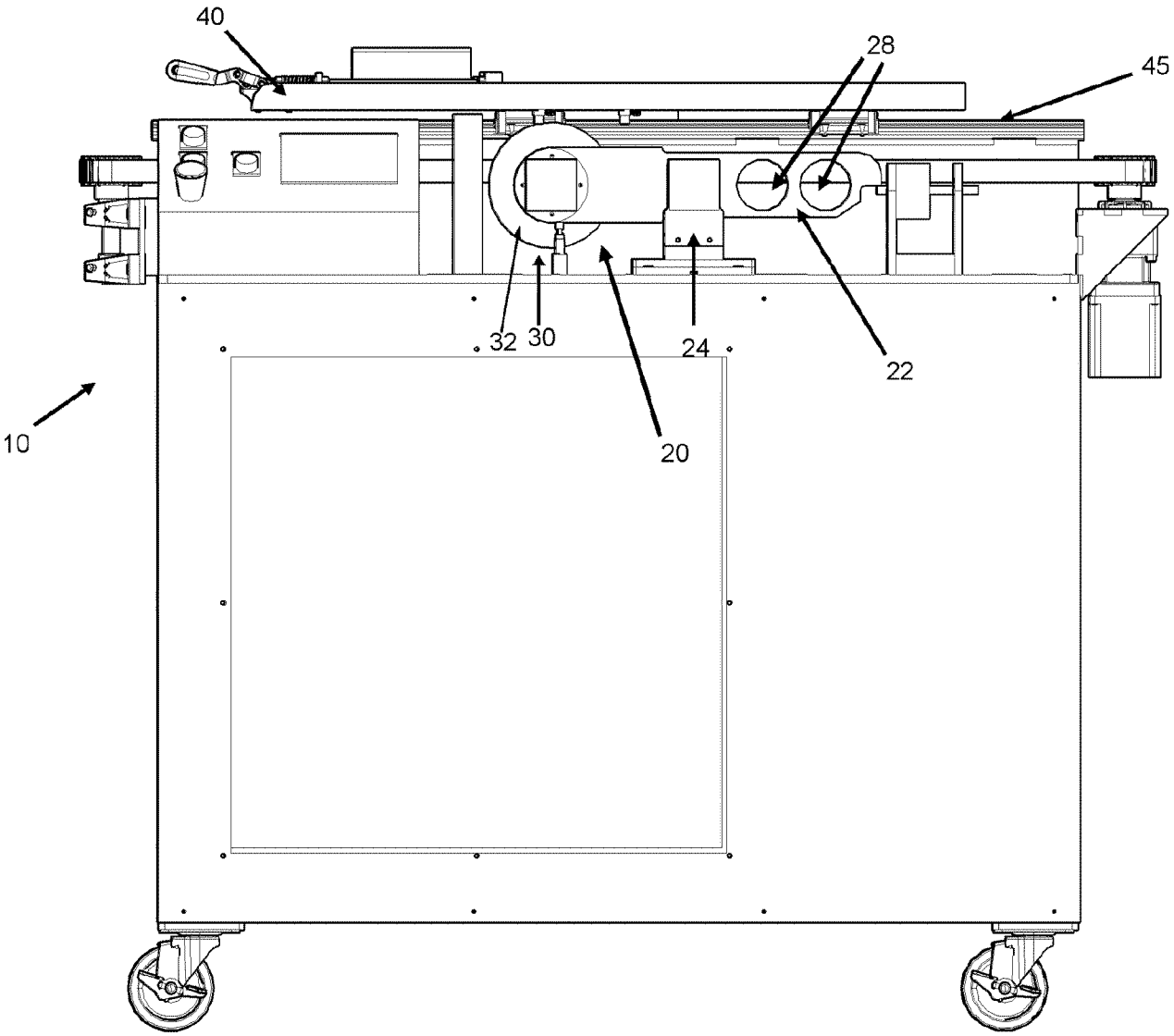
FIG. 8 illustrates a blade sharpening device and a blade holding device from a blade sharpening system according to an embodiment of the present invention.
Figure 9:
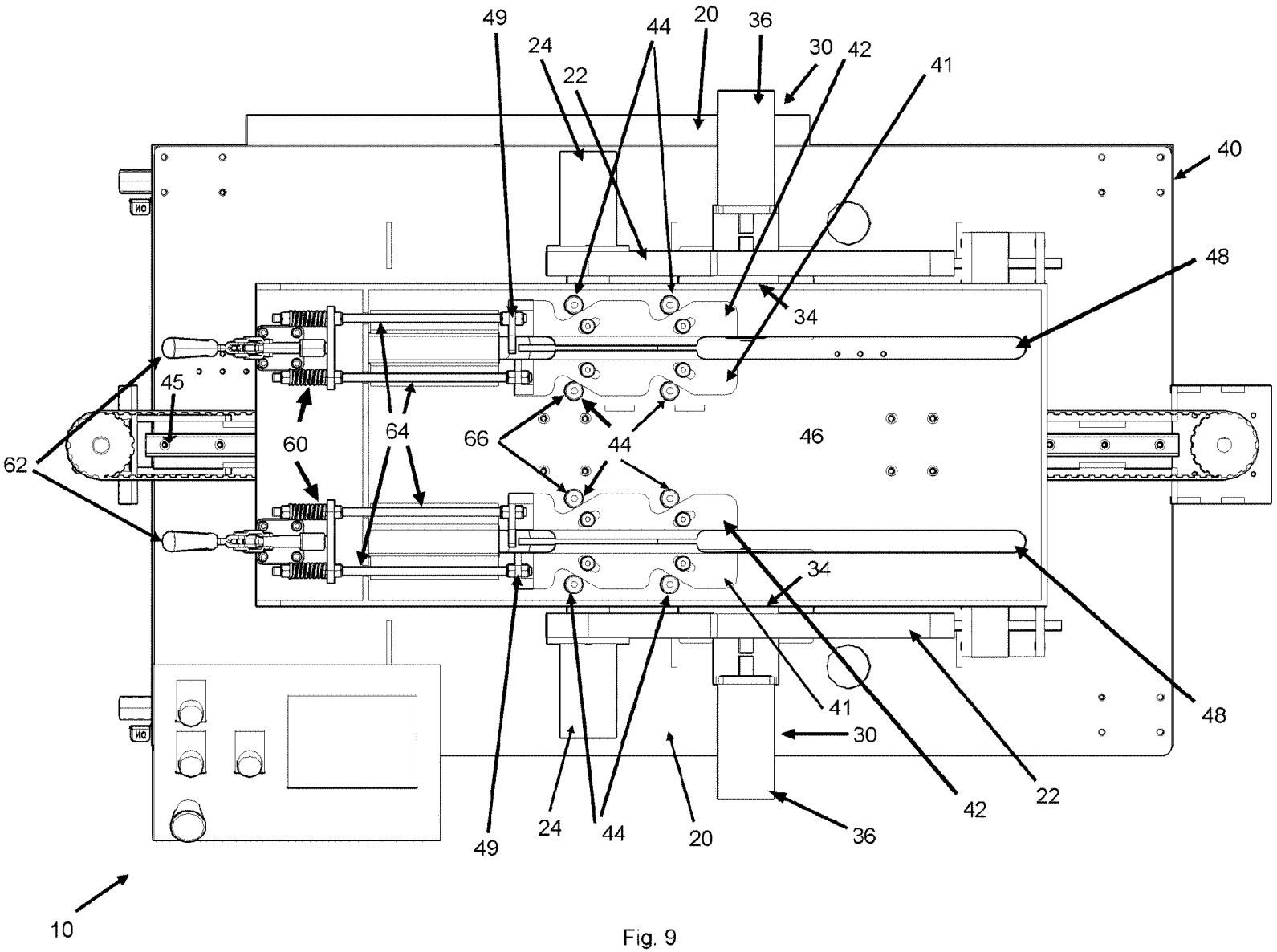
FIG. 9 illustrates a blade holding device over a blade sharpening device from a blade sharpening system according to an embodiment of the present invention.
Figure 10:
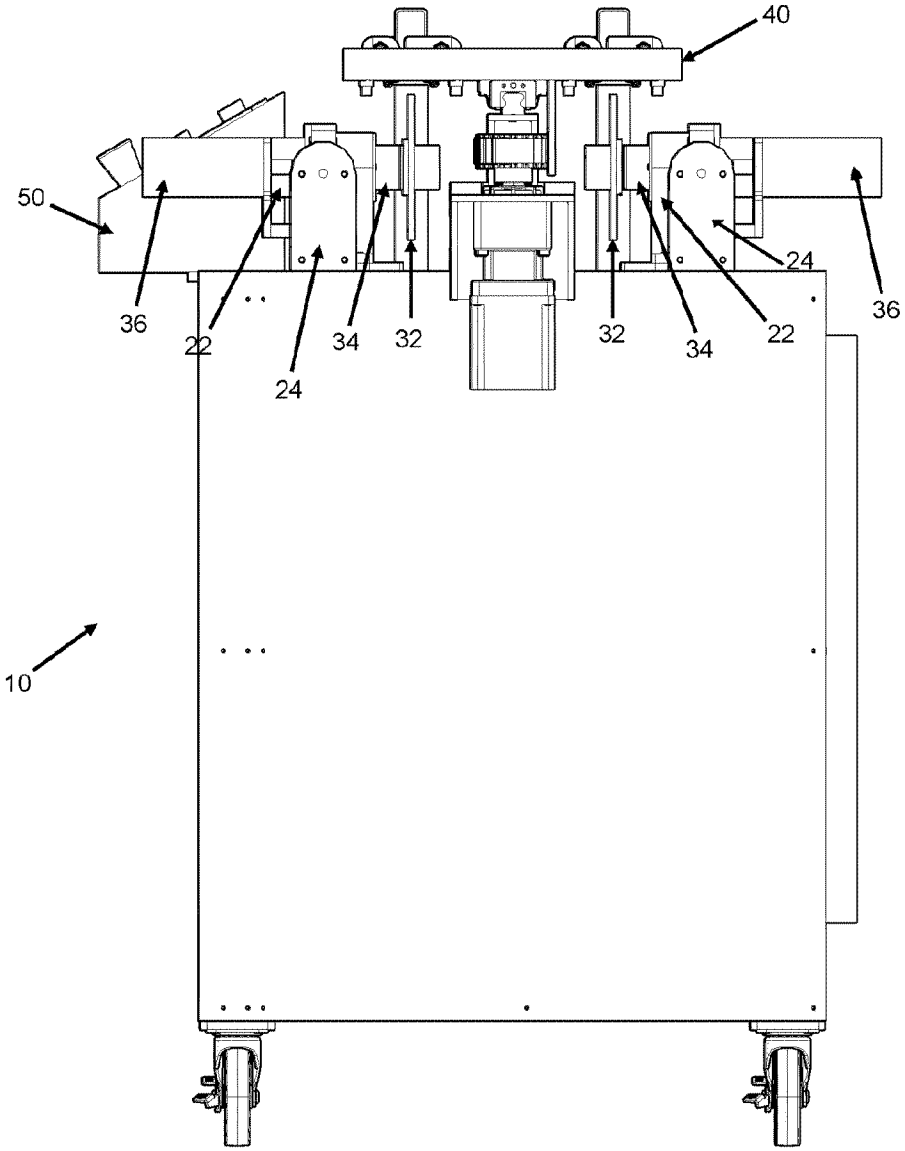
FIG. 10 illustrates a side view of a blade sharpening device and a blade holding device from a blade sharpening system according to an embodiment of the present invention.
Figure 11:
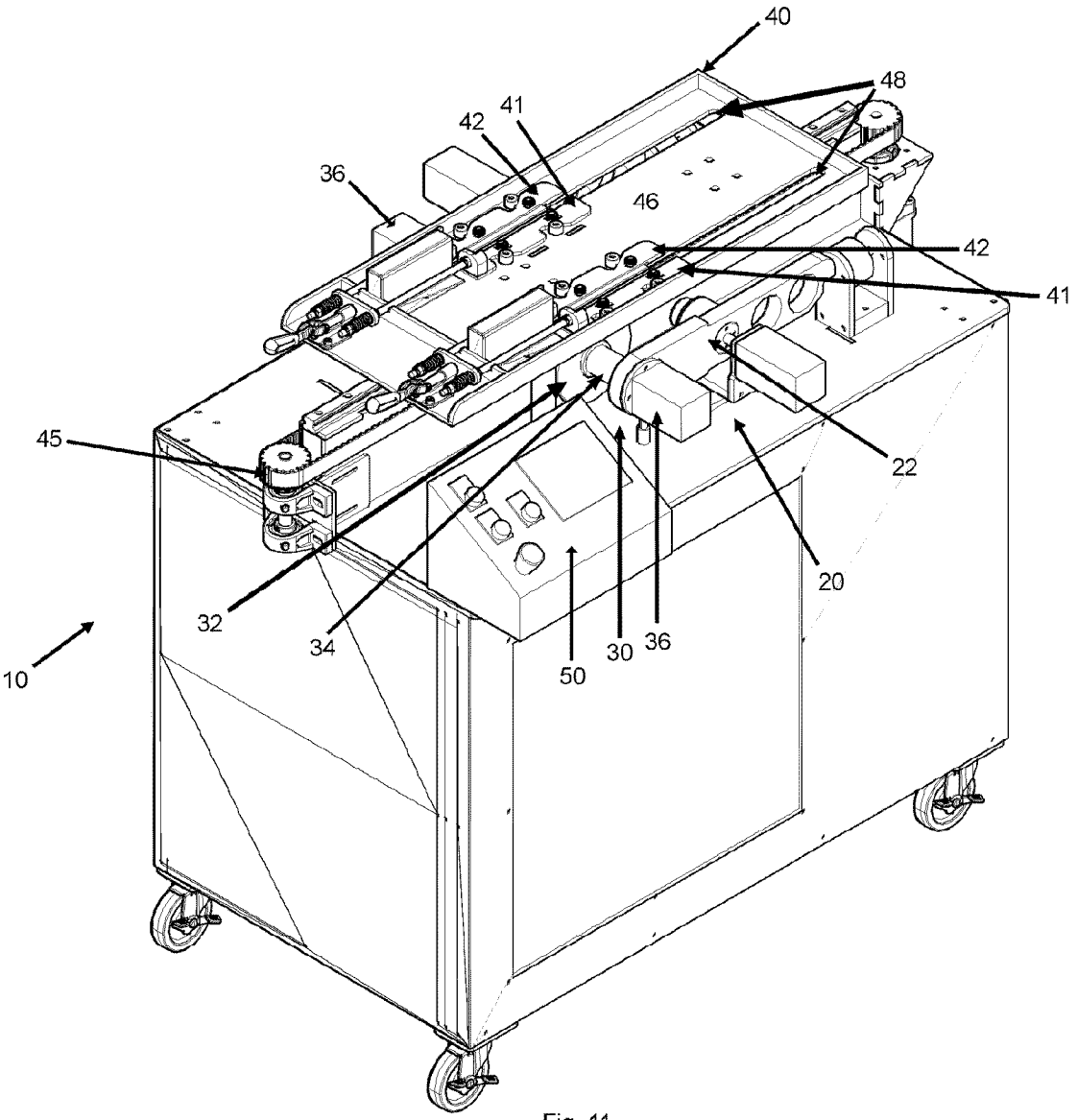
FIG. 11 illustrates a blade sharpening system according to an embodiment of the present invention.

Referring now to the drawings, and more particularly to FIGS. 1 to 5 and 7 to 11, which illustrates a blade sharpening system 10 according to the present invention. The blade sharpening system 10 of the present invention may be used for sharpening at the same time one or more blades, and therefore, when the present invention is described as containing one element or part, it is within the purview of the person skilled in the art to adapt the disclosed subject matter to include more than one such element. For example, a system of the present invention could be designed to sharpen two blades at the same time.

The blade sharpening system 10 of the present invention comprises a blade sharpening device 20 configured to contact the blade. The blade sharpening device 20 includes a grinding assembly 30, which is configured to slide according to the longitudinal trajectory along the length of the blade, and grind it. Furthermore, grinding assembly 30 is also configured to perform at least one additional task of grinding the blade with a variable grinding pressure, measure the shape of the blade, and/or grind the blade according to the measured shape of the blade with a variable grinding pressure.

The grinding assembly 30 includes a grinding means, which may be any suitable grinding means. In an embodiment, the grinding means may be a grinding belt, strap, sheet, milling tool, rod, wheel, or the likes, having the necessary abrasive and/or grinding properties, and being appropriately mounted and driven.

According to an embodiment, the grinding assembly 30 comprises a grinding wheel 32, which may be demountably attached to a spindle 34 operatively coupled to a grinding wheel drive system 36. The grinding wheel 32 is configured to contact and sharpen the blade with a variable grinding pressure. According to an embodiment, the grinding assembly 30 may comprise sensor means measuring the pressure being applied to the blade. Measurement of the pressure applied allows the system 10 of the present invention to adjust the pressure applied to the blade, such that predetermined desired pressures may be applied to the blade. According to an embodiment, the pressure may be held constant along the length of the blade, and according to another embodiment, the pressure may be varied along the different portions of the blade. For example, the pressures applied to the extremities of the blade (e.g. beginning and end) may be sufficiently low to prevent deformation of these extremities upon initial contact of the grinding. The pressure applied to the central portion of the blade may be higher than that applied to the extremities, as contact with the blade is already initiated and the risks of deformation of the blade much lower.

According to another embodiment, the grinding assembly 30 is configured to measure the shape of the blade being sharpened. According to an embodiment, the grinding assembly 30 may comprise sensor means for measuring the shape of the blade. Upon initiation of contact between the grinding assembly 30 and the blade, the sensor measures the position of the point of contact with the blade, and once records it. According to embodiments, the shape of the blade may be measured before a sharpening cycle of the system of the present invention, where the grinding assembly contacts the blade for measuring the shape without simultaneous sharpening. According to an embodiment, the shape of the blade may be measured at the same time as the sharpening of the blade. According to another embodiment, the shape of a part of the blade may be measured before sharpening of the blade begins. According to another embodiment, the shape of a part of a blade may be measured during simultaneous sharpening of the part of a blade. According to another embodiment, the shape of a part of a blade may be measured, and then sharpened, and the remaining part of the blade may be measured while being simultaneously sharpened. Furthermore, the system 10 of the present invention may begin sharpening and/or measuring from any extremity of a blade, or even from any portion of the blade.

According to another embodiment, the centerline of the grinding wheel 32 may be configured to be in longitudinal alignment with the corresponding centerline of the edge of the blade. According to another embodiment, the grinding wheel 32 may comprise a contour having a convex arcuate surface with a radius from about 0.25 inch to about 3 inch (0.635 cm to 7.62 cm). The perfect alignment results in a perfectly concave edge on the blade being sharpened, resulting in an optimal skating blade.

According to another embodiment, the blade sharpening device 20 may further comprise a lever 22, which is configured to pivot the grinding assembly 30 according to the predetermined shape of the blade. For example, lever 22 may be pivotally mounted on pivot 24. According to another embodiment, the blade sharpening device 20 may further comprise an arm 26, which is pivotally coupled to the lever 22 to actuate and pivot the lever 22 according the predetermined shape of the blade. Now referring to FIG. 5, according to another embodiment, the blade sharpening device 20 may further comprise a cam 29, which is coupled to an arm 26. Rotational movement of the cam 29 actuates the arm 26, which is pivotally coupled to the lever 22 to actuate and pivot the lever 22 according to the predetermined shape of the blade. According to an embodiment, the lever 22, arm 26, and cam 29 may all be operatively coupled to a drive means which is controlled by the controller 50 to move these parts and pivot the grinding assembly 30.

According to another embodiment, the blade sharpening device 20 may further comprise a balancing mechanism to counterbalance weight of the grinding assembly 30. For example, the balancing mechanism may be a weight, a retaining arm, or the likes or a combination thereof. Preferably, the balancing mechanism is a weight. For example, according to an embodiment, the weight may be a series of weights 28 mounted in lever 22 in order to equilibrate the weight of the grinding assembly 30 mounted at the extremity of the lever 22.

According to another embodiment, the drive 36 may be any suitable drive means. According to a preferred embodiment, the drive 36 may be a servomechanism such as a servomotor. The servomechanism includes an error sensing negative feedback mechanism to correct the performance of the mechanism. The feedback or error-correction signals help control mechanical position, speed, and other parameters such as pressure applied. According to an embodiment, a servomotor is a specific type of servomechanism which may be used in the present invention, where a motor and a rotary encoder are combined to form the servomotor. It consists of a suitable motor coupled to a sensor for position and speed feedback. It also requires a relatively sophisticated controller, often a dedicated module designed specifically for use with servomotors.

The blade sharpening system 10 of the present invention also includes a blade holding apparatus 40, which slides the blade over the blade sharpening device 20. The blade holding apparatus 40 may be slided by any suitable means or assembly capable of smoothly sliding it. For example, one or more rails operatively coupled to drive to move back and forth the blade holding apparatus 40 could be used. The blade holding apparatus 40 may be mounted on wheels and operatively coupled to drive to move it back and forth. The blade holding apparatus 40 may be mounted on a linear bearing and operatively coupled to drive to move it back and forth. According to an embodiment, the blade holding apparatus 40 may be coupled to a linear bearing 45. The blade holding apparatus 40 includes parallel first and second gripping members 41, 42, that contact opposite sides of the blade and align an edge of the blade with the grinding wheel 32 for sharpening.

The blade holding apparatus may further comprise a stage 46, having at least one longitudinal slot 48 in longitudinal alignment with the grinding wheel 30. According to another embodiment, the parallel first and second gripping members 41, 42 may be slidably mounted on the stage 46 over the longitudinal slot 48, for aligning the blade within the longitudinal slot.

According to another embodiment, the blade holding apparatus 40 may further comprise an actuating member 60 to bring the first and second parallel gripping members 41, 42 in proximity to one another. When the first and second parallel gripping members 41, 42 are brought in proximity in this fashion, the blade to be sharpened is held between the parallel gripping members 41, 42. The actuating member 60 may be any suitable means of bringing the first and second parallel gripping members 41, 42 in proximity. For example, the actuating member may push on the external sides of the parallel gripping members 41, 42 to bring them near one another and clamp on the blade. Alternatively, the actuating member 60 may push or pull on the parallel gripping members 41, 42 to bring them near one another and clamp on the blade. Now referring to FIG. 3, there is shown actuating members 60 comprising levers 62 connected to spring loaded rods 64. Rods 64 are connected to the first and second parallel gripping members 41, 42, which are pulled upon during actuation of the lever 62. Guiding members 66, inserted in slots in the first and second parallel gripping members 41, 42 ensure that the first and second parallel gripping members 41, 42 slide toward each other and clamp on the blade there between.

According to another embodiment, the blade holding apparatus 40 further comprises adjustable grip tuning members 44 that abut the first or the second parallel gripping members 41, 42 to provide a substantially even gripping pressure along the blade and straighten the blade prior to sharpening. According to another embodiment, the adjustable grip tuning members 44 allow the first or the second parallel gripping members 41, 42 to slide against the adjustable grip tuning members 44, which in combination with the guiding members 66, guide the first or the second parallel gripping members 41, 42 against one another to clamp around a blade there between.

According to another embodiment, the blade holding apparatus 40 may further comprises a blade extremity rest 49, to about a blade extremity to position the blade in the blade holding apparatus 40.

The blade sharpening system 10 of the present invention also includes a controller 50, which is operatively coupled to the blade sharpening device 20 and the blade holding apparatus 40. The controller 50 is configured to at least control sharpening of the blade according to the variable grinding pressure, measure the shape of the blade, and control sharpening of the blade according to the measured shape of the blade according to the variable grinding pressure exerted during sharpening on the blade by the grinding assembly.

According to an embodiment, the controller 50 is also operable to

- control sharpening of the blade
- control the grinding rotation speed of the grinding wheel 32;
- control the constant or variable grinding pressure of the grinding wheel 32;

control the position of the blade sharpening device 20 according to a predetermined shape of the blade;

measuring the shape of the blade;

control motion of the blade holding apparatus 40; and combinations thereof.

According to an embodiment, the controller 50 may comprise one or more processor, and a memory. The controller 50 may be further operable to receive and store a blade sharpening parameter set. For example, the blade sharpening parameter set may be stored in the memory of the controller 50. The blade sharpening parameter set may include numerous parameters, non-limiting examples of which include:

The height of the grinding wheel 32 with respect to the blade at start of grinding. This parameter specifies the position of the grinding wheel 32 at the entry/extremities (e.g. the tip) of the blade to begin grinding, and will be different according to the type and/or the make of the blade. This parameter may empirically determined by measurements provided and stored in the system.

The height of the grinding wheel with respect to the blade at end of grinding is a parameter that specifies the position of the grinding wheel 32 when it is at the end of the blade. Specifically, it locks the position of the grinding wheel 32 (e.g. through locking arm 26) after sharpening of the blade to prevent the blade sharpening device 30 from moving upwards toward the bottom of a skate and damage the boot of the skate. It may also position the grinding wheel 32 in such a manner that it prevents deformation of the blade upon exit.

The initial point of contact with the blade (with the grinding wheel 32). This parameter is a point in space just before the contact is initiated between the grinding wheel 32 and the blade; Depending of the make and/or shape of the blade, the initial point of contact will range from about 10 thousandth of an inch to 70 thousandth of an inch (from about 250 μm to about 1800 μm).

Speed of the blade holding apparatus, is a parameter that specifies the speed at which the blade holding apparatus travels during the grinding of the blade. The speed of the blade holding apparatus 40 is also held constant during grinding, and it may vary from about 1 inch to 2 inches per seconds (2.54 cm/sec to about 5.08 cm/sec).

Acceleration time of the blade holding apparatus is a parameter that determined how much time the blade holding apparatus will take to achieve the travelling speed of the blade holding apparatus 40 when it is grinding the blade, from a completely stationary (stopped) position. According to an embodiment, the acceleration time of the blade holding apparatus may be from about 0.5 seconds to about 2 seconds, or from about 0.5 seconds to about 1.5 seconds, or from about 0.5 seconds to about 1.0 seconds.

Cam speed may also be specified to move the cam according to a constant speed in order to stabilize the blade grinding process and prevent deformation of the blades. Cam speed may vary from about 0 degree (stopped) to about 90 degrees per second.

Cam acceleration time may also be specified in order to further stabilize the grinding process and prevent deformation of the blades. The acceleration time specifies how long the cam will accelerate from a complete stop position to the desired cam speed. The acceleration may be from about 10 degrees per second to about 30 degrees per second.

The grinding wheel drive system delay is also a parameter that may be specified. This parameter specifies how long the grinding wheel drive system will be turned on before grinding begins. This prevents cases where the grinding wheel and the blade are put into contact while the wheel is stopped or has not reached the desired grinding rotation speed.

The shape of a blade is that of the blade being sharpened, which may have been measured by the system 10 prior to or during sharpening.

The predetermined shape of a blade is the shape of the blade that is being sharpened based on measurements made prior to sharpening.

The variable grinding pressure for a given blade, represents the pressure (or weight) being applied on the blade during grinding. This pressure may be from about 1 ounce to about 25 ounces (about 28 grams to about 709 grams), or from about 2 ounce to about 25 ounces (about 56 grams to about 709 grams), or from about 3 ounce to about 25 ounces (about 85 grams to about 709 grams), or from about 4 ounce to about 25 ounces (about 113 grams to about 709 grams), or from about 5 ounce to about 25 ounces (about 142 grams to about 709 grams), or from about 6 ounce to about 25 ounces (about 170 grams to about 709 grams), or from about 7 ounce to about 25 ounces (about 198 grams to about 709 grams), or from about 8 ounce to about 25 ounces (about 227 grams to about 709 grams), or from about 9 ounce to about 25 ounces (about 255 grams to about 709 grams), or from about 10 ounce to about 25 ounces (about 283 grams to about 709 grams), or from about 11 ounce to about 25 ounces (about 312 grams to about 709 grams), or from about 12 ounce to about 25 ounces (about 340 grams to about 709 grams), or from about 13 ounce to about 25 ounces (about 369 grams to about 709 grams), or from about 14 ounce to about 25 ounces (about 397 grams to about 709 grams), or from about 15 ounce to about 25 ounces (about 425 grams to about 709 grams), or from about 16 ounce to about 25 ounces (about 454 grams to about 709 grams), or from about 17 ounce to about 25 ounces (about 482 grams to about 709 grams), or from about 18 ounce to about 25 ounces (about 510 grams to about 709 grams), or from about 19 ounce to about 25 ounces (about 534 grams to about 709 grams), or from about 20 ounce to about 25 ounces (about 567 grams to about 709 grams), or from about 21 ounce to about 25 ounces (about 595 grams to about 709 grams), or from about 22 ounce to about 25 ounces (about 624 grams to about 709 grams), or from about 23 ounce to about 25 ounces (about 652 grams to about 709 grams), or from about 24 ounce to about 25 ounces (about 680 grams to about 709 grams), or from about 25 grams to about 700 grams, or from about 50 grams to about 700 grams, or from about 100 grams to about 700 grams, or from about 200 grams to about 700 grams, or from about 300 grams to about 700 grams, or from about 400 grams to about 700 grams, or from about 500 grams to about 700 grams, or from about 600 grams to about 700 grams, and may vary according to the portion of the blade being sharpened, as described above. For example, the extremities may be contacted with lower pressures (e.g. 25 grams) than the central portion of the blade (e.g. 200 grams), so as to not distort them.

The constant grinding pressure for a given blade, represents the pressure (or weight) being applied on the blade during grinding. This pressure may be from about 1 ounce to about 25 ounces (about 28 grams to about 709 grams), or from about 2 ounce to about 25 ounces (about 56 grams to about 709 grams), or from about 3 ounce to about 25 ounces (about 85 grams to about 709 grams), or from about 4 ounce to about 25 ounces (about 113 grams to about 709 grams), or from about 5 ounce to about 25 ounces (about 142 grams to about 709 grams), or from about 6 ounce to about 25 ounces (about 170 grams to about 709 grams), or from about 7 ounce to about 25 ounces (about 198 grams to about 709 grams), or from about 8 ounce to about 25 ounces (about 227 grams to about 709 grams), or from about 9 ounce to about 25 ounces (about 255 grams to about 709 grams), or from about 10 ounce to about 25 ounces (about 283 grams to about 709 grams), or from about 11 ounce to about 25 ounces (about 312 grams to about 709 grams), or from about 12 ounce to about 25 ounces (about 340 grams to about 709 grams), or from about 13 ounce to about 25 ounces (about 369 grams to about 709 grams), or from about 14 ounce to about 25 ounces (about 397 grams to about 709 grams), or from about 15 ounce to about 25 ounces (about 425 grams to about 709 grams), or from about 16 ounce to about 25 ounces (about 454 grams to about 709 grams), or from about 17 ounce to about 25 ounces (about 482 grams to about 709 grams), or from about 18 ounce to about 25 ounces (about 510 grams to about 709 grams), or from about 19 ounce to about 25 ounces (about 534 grams to about 709 grams), or from about 20 ounce to about 25 ounces (about 567 grams to about 709 grams), or from about 21 ounce to about 25 ounces (about 595 grams to about 709 grams), or from about 22 ounce to about 25 ounces (about 624 grams to about 709 grams), or from about 23 ounce to about 25 ounces (about 652 grams to about 709 grams), or from about 24 ounce to about 25 ounces (about 680 grams to about 709 grams), or from about 25 grams to about 700 grams, or from about 50 grams to about 700 grams, or from about 100 grams to about 700 grams, or from about 200 grams to about 700 grams, or from about 300 grams to about 700 grams, or from about 400 grams to about 700 grams, or from about 500 grams to about 700 grams, or from about 600 grams to about 700 grams.

The constant grinding rotation speed may be from about 6250 feet/min to about 7860 feet/min (about 1905 m/min to about 2394 m/min).

The number of sharpening cycles simply specifies the number of times the blade will be sharpened by the grinding wheel until the system is stopped.

According to another embodiment, the blade sharpening system 10 may be further operable to be accessible from a computer network, and/or it may comprise suitable connections to allow a user to input external data, such as new blade sharpening parameter sets.

According to another embodiment, the blade sharpening system of the present invention may further comprise a dust collecting apparatus (such as a vacuum pump, a vacuum cleaner, a filter connected to a negative pressure source, or the likes) for collection of dust generated from grinding the blade.

According to another embodiment, in use, the blade sharpening system 10 of the present invention sharpens blades according to at least one of steps a) and a') together, and step b):

a) measuring a shape of a first portion of a blade mounted on the blade holding apparatus 40 by contacting the first portion of a blade with the grinding assembly 30 configured for measuring a shape of the blade; and a') contacting the blade with the grinding assembly 30 to sharpen the first portion of the blade according to the shape of the first portion of the blade, and sharpening and measuring the shape of a second portion of the blade by contacting the second portion of the blade with the grinding assembly configured for measuring a shape of the blade, and b) contacting and sharpening a blade mounted on the blade holding apparatus 40 with the grinding assembly 30 according to a pressure profile comprising a first pressure when contacting and sharpening a first extremity of the blade;

a second pressure, higher than the first pressure, when contacting and sharpening the central portion of the blade, and a third pressure, lower than the second pressure when contacting and sharpening the second extremity portion of the blade, according to an entire shape of the blade obtained from the first and second measured portion of the blade, to prevent deformation of the first and second extremity of the blade.

According to another embodiment, in use, the blade sharpening system 10 of the present invention sharpens blades according to the following steps:

a) measuring an entire shape of the blade mounted on the blade holding apparatus 40 by contacting the first or second extremity of a blade with the grinding assembly 30 configured for measuring a shape of the blade, and measuring the entire shape of the blade; and b) contacting and sharpening the blade mounted on the blade holding apparatus 40 with the grinding assembly according to a pressure profile comprising a first pressure when contacting and sharpening the first extremity of the blade;

a second pressure, higher than the first pressure, when contacting and sharpening the central portion of the blade, and a third pressure, lower than the second pressure when contacting and sharpening the second extremity portion of the blade, according to the entire shape of the blade, to prevent deformation of the first and second extremity of the blade.

According to another embodiment, in use, the blade sharpening system 10 of the present invention sharpens blades according to the following steps:

a) measuring an entire shape of, and simultaneously sharpening the blade mounted on the blade holding apparatus 40 by contacting the first or second extremity of a blade with the grinding assembly 30 configured for measuring a shape of the blade, according to a pressure profile comprising a first pressure when contacting and sharpening the first extremity of the blade;

a second pressure, higher than the first pressure, when contacting and sharpening the central portion of the blade, and a third pressure, lower than the second pressure when contacting and sharpening the second extremity portion of the blade, according to the entire shape of the blade to prevent deformation of the first and second extremity of the blade.

Sharpening blades according to the variable grinding pressure may be performed from about 1 to about 25 ounces-28 to 708 grams of pressure/weight, or from about 25 to 700 grams). A constant grinding rotation speed may be applied, for example from about 6250 feet/min to about 7860 feet/min (about 1905 m/min to about 2394 m/min) of the grinding wheel. According to an embodiment, these parameters may be predetermined or measured by the system and available to the blade sharpening system 10 of the present invention according to any type and/or make of the blade being sharpened. According to another embodiment, the constant grinding rotation speed may be the same for all blades, irrespective of the types and makes of blades.

According to an embodiment, the pressure applied on the blade being sharpened may be maintained constant over the entire length of the surface/edge being sharpened. According to another embodiment, the pressure applied on the blade being sharpened may be varied between the extremities and central portion of the surface/edge being sharpened. This is to avoid deformation of the blade's extremities, resulting from the contact of the blade sharpening assembly with these extremities. According to an embodiment, the speed of the blade holding apparatus 40 is also held constant, also to ensure an even sharpening over the entire length of the edge being sharpened resulting in an imperfect and non-optimal blade.

According to another embodiment, a constant grinding rotation speed may be maintained over the entire length of the surface/edge being sharpened to prevent unnecessary heating of the blade being sharpened, which prevents deformation and hardening of the blade during sharpening.

According to an embodiment, the grinding pressure and constant grinding rotation speed are also influenced by the weight of the grinding assembly 30, and balancing the weight with a balancing mechanism contributes to the system's blade sharpening device stability and its ability to deliver such constant grinding pressure and rotation speed. According to another embodiment, actuation and pivoting of the lever 22 by arm 26 with cam 29 also allows the system of the present invention to ability to deliver such constant grinding pressure and rotation speed.

The grinding assembly 30 is positioned according to the blade sharpening parameter set provided for a given blade, and the blade holding apparatus 40 is moved toward the grinding assembly 30, which then contacts the blade and sharpen it according to the variable grinding pressures of the grinding wheel 30. This may be repeated as many times as required in order to obtain an adequately sharpened blade. The blade resulting therefrom is an even and highly reproducible blade. The blade is straightened just prior to sharpening, and the constant grinding pressure and rotation speed prevent the introduction of undesired alterations to the blade, such as grooves and hardened sections.

According to another embodiment, the grinding assembly 30 is positioned according to the blade sharpening parameter set provided for a given blade, and the blade holding apparatus 40 is moved toward the grinding assembly 30, which then contacts the blade and measure the shape of a first portion of the blade mounted on the blade holding apparatus 40 by contacting the first portion of the blade with the grinding assembly 30 configured to measure the shape of the blade; and then contact the blade with the grinding assembly 30 to sharpen the first portion of the blade, and sharpen and measure the shape of the second portion of the blade by contacting the second portion of the blade with the grinding assembly 30 configured to measure the shape of the blade. Once the shape of the blade has been measured and stored within the system, the sharpening steps may be repeated as many times as required in order to obtain an adequately sharpened blade. The blade resulting therefrom is an even and highly reproducible blade. The blade is straightened just prior to sharpening, and the constant grinding pressure and rotation speed prevent the introduction of undesired alterations to the blade, such as grooves and hardened sections.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A blade sharpening system comprising:

a blade sharpening device configured to contact a blade, comprising:

a grinding assembly, configured to measure a shape of said blade; and grind said blade according to said measured shape of said blade with a variable grinding pressure which is variable along the length of said blade;

a blade holding apparatus to slide said blade over said blade sharpening device, comprising parallel first and second gripping members for contacting opposite sides of said blade and align an edge of said blade with said grinding assembly; and a controller operatively coupled to said blade sharpening device and said blade holding apparatus, configured to:

control the grinding assembly to measure said shape of said blade, or receive and store a shape of said blade, and control sharpening of said blade according to said measured or stored shape of said blade by exerting said variable grinding pressure which is variable during sharpening on said blade by said grinding assembly.

2. The blade sharpening system of claim 1, wherein said grinding assembly comprises grinding means.

3. The blade sharpening system of claim 2, wherein said grinding means comprises a grinding belt, a grinding strap, a grinding sheet, a milling tool, a grinding rod, a grinding wheel, or combinations thereof.

4. The blade sharpening system of claim 2, wherein said grinding means comprises a grinding wheel which is demountably attached to a spindle operatively coupled to a grinding wheel drive system, wherein said grinding wheel drive system is a servomechanism.

5. The blade sharpening system of claim 4, wherein said controller is also operable to at least one of:

control sharpening of the blade control a grinding rotation speed of said grinding wheel;

control the variable grinding pressure of said grinding wheel;

control the position of said blade sharpening device according to a predetermined shape of said blade;

measuring the shape of said blade;

control motion of said blade holding apparatus; and combinations thereof.

6. The blade sharpening system of claim 4, wherein said controller is further operable to receive and store a blade sharpening parameter set.

7. The blade sharpening system of claim 6, wherein said blade sharpening parameter set comprises at least one of: a height of said grinding wheel with respect to the blade at a start of a grinding contact, a height of said grinding wheel with respect to the blade at an end of the grinding contact, an initial point of contact of said grinding wheel with said blade, acceleration time of the blade holding apparatus, speed of the blade holding apparatus, cam speed, cam acceleration time, grinding wheel drive system delay, a predetermined shape of a blade, a variable grinding pressure for a given blade, a constant grinding pressure for a given blade, a constant grinding rotation speed for a given blade, a number of sharpening cycles, and combinations thereof.

8. The blade sharpening system of claim 4, wherein said grinding wheel is configured to contact said blade with a variable grinding pressure.

9. The blade sharpening system of claim 4, wherein a centerline of said grinding wheel is configured to be in longitudinal alignment with a centerline of said edge of said blade.

10. The blade sharpening system of claim 4, wherein said grinding wheel comprises a contour having a convex arcuate surface with a radius from about 0.25 inch (0.635 cm) to about 3 inches (7.62 cm).

11. The blade sharpening system of claim 1, wherein said grinding assembly comprises pressure sensor means for measuring pressure applied to said blade, or a shape sensor means for measuring said shape of said blade, or both.

12. The blade sharpening system of claim 1, wherein said blade sharpening device further comprises a lever configured to pivot said grinding assembly according to a predetermined shape of the blade.

13. The blade sharpening system of claim 12, wherein said blade sharpening device further comprises an arm pivotally coupled to said lever to actuate and pivot said lever according to the predetermined shape of the blade.

14. The blade sharpening system of claim 13, wherein said blade sharpening device further comprises a cam coupled to said arm to actuate said arm, said arm being pivotally coupled to said lever to actuate and pivot said lever according to the predetermined shape of the blade.

15. The blade sharpening system of claim 14, wherein said blade sharpening device further comprises a drive means operatively coupled to any one of said level, arm or cam, said drives means being controlled by said controller.

16. The blade sharpening system of claim 1, wherein said blade sharpening device further comprises a balancing mechanism to counterbalance weight of said grinding assembly.

17. The blade sharpening system of claim 1, wherein said blade holding apparatus further comprises adjustable grip tuning members for abutting said first and second parallel gripping members to provide a substantially even gripping pressure along said blade to straighten said blade.

18. The blade sharpening system of claim 4, wherein said blade holding apparatus further comprises a stage having at least one longitudinal slot in longitudinal alignment with said grinding wheel and wherein said parallel first and second gripping members are slidably mounted on said stage over said longitudinal slot, for aligning said blade within said longitudinal slot.

19. The blade sharpening system of claim 1, wherein said variable grinding pressure has a value determined according to a type of said blade.

20. A method of sharpening a blade with the blade sharpening system of claim 1, comprising contacting at least once said blade with said blade sharpening system.

* * * * *